United States Patent [19]

Kosteck

[11] Patent Number: 4,660,263

[45] Date of Patent: Apr. 28, 1987

[54] VAPOR BLASTED BULLET JACKET

[75] Inventor: Gregory R. Kosteck, Godfrey, Ill.

[73] Assignee: Olin Corporation, Stamford, Conn.

[21] Appl. No.: 771,336

[22] Filed: Sep. 20, 1985

Related U.S. Application Data

[63] Continuation-in-part of Ser. No. 666,051, Oct. 29, 1984, abandoned.

[51] Int. Cl.[4] ..... B21K 21/06; B24B 1/00

[52] U.S. Cl. ..... 29/1.23; 51/321

[58] Field of Search ..... 29/1.2–1.23; 51/410, 411

[56] References Cited

U.S. PATENT DOCUMENTS

| | | | |
|---|---|---|---|
| 3,242,515 | 3/1966 | Baeten et al. | 52/410 |
| 3,392,052 | 7/1968 | Davis | 117/212 |
| 3,427,763 | 2/1969 | Maasberg et al. | 51/321 |
| 3,431,612 | 3/1969 | Darigo et al. | 29/1.23 |

*Primary Examiner*—Howard N. Goldberg
*Assistant Examiner*—Steven Nichols
*Attorney, Agent, or Firm*—Bruce E. Burdick

[57] ABSTRACT

The invention provides a technique for vapor blasting the interior of regular production bullet jackets prior to lead seating. The controlled vapor blasting significantly increases the surface roughness of the bullet jacket interior. As a result, the formed bullet has greater adhesion between the bullet jacket and lead core.

2 Claims, 5 Drawing Figures

Figure 5:
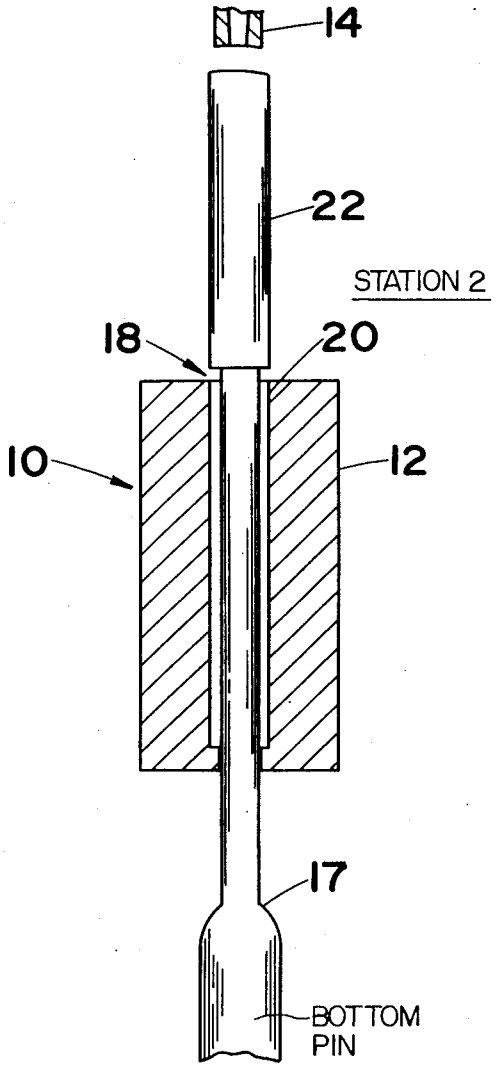

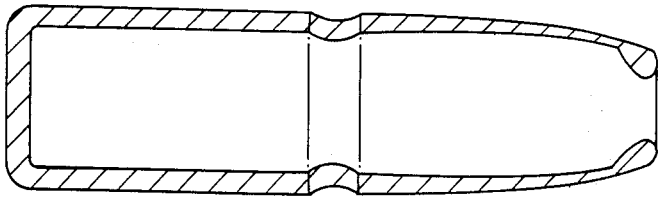
FIG. 1
FIG. 2
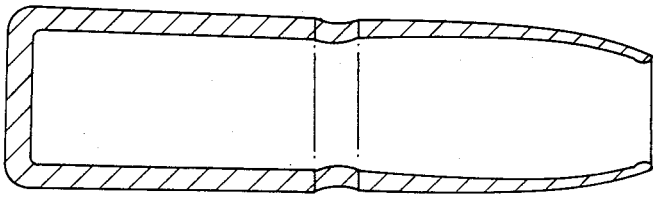
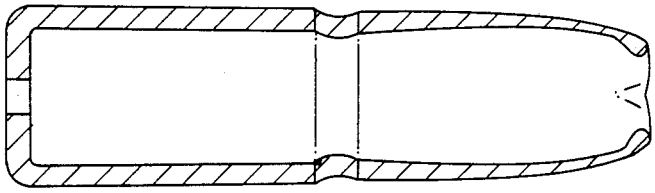
FIG. 3

VAPOR BLASTED BULLET JACKET

This invention is a continuation-in-part of co-pending U.S. patent application Ser. No. 666,051, filed Oct. 29, 1984, now abandoned and relates to a method of making bullets, particularly expanding bullets.

Core-jacket separations in extending bullets are a known concern. Various methods have been tried, and mostly complex, to solve this concern. A better solution is needed.

It is an object of this invention to provide a method of significantly reducing the relative slip between the bullet jacket and core, therefore reducing the incidence of undesired core-jacket separations in jacketed hunting bullets.

Since bullet jackets are conventionally made of very thin relatively soft metal such as copper, the conventional method of roughening a bullet jacket is to knurl the exterior as in U.S. Pat. No. 3,431,612 issued Mar. 11, 1969 to Darigo et al, thus putting an indentation or projection on the interior of the jacket after the lead bullet core is seated in the jacket. However, for mushrooming bullets such as are typically used for hunting game (e.g. deer, elk, antelope, moose, bears, lions, tigers, etc.), the knurl is normally located so far forward that it is torn apart as the bullet expands. This is so because the primary purpose of the knurl is either to hold bullet lubricant or provide a location for crimping of the mouth of the cartridge case into better engagement with the bullet than would be possible without a crimp.

Another past method of attempting to decrease slippage of the bullet jacket relative to the core was a partition (e.g. the Nosler "partition bullet") but this can allow the front core portion to separate and is thus an unsatisfactory method. Yet another method is a rearward facing internal burr (e.g. the Hornady "interlock") which either does little (if small) or tends to cause core splits (if large).

Sandblasting has not been tried, perhaps because it cannot be done after the lead is seated and perhaps because bullet jackets are almost always formed from metal cups which have a closed end so that blasting media just accumulates in the cup with little net effect. Also, the jacket cup is so thin that blasting would just bulge it out of shape. Also, the cup is so small generally that a special small nozzle would seemingly be needed to get into the interior of the jacket cup and that small a nozzle might be too small to pass media of sufficient size to do any good. Also, blasting, especially vapor blasting, is traditionally for cleaning not roughening, although there has been large scale use of blasting for roughening large open pieces such as the side of buildings or sheet metal or even tubes, such as for example U.S. Pat. No. 3,427,763 issued Feb. 18, 1969 to Maasberg et al. Thus far, no one has been able to adapt "blasting" to bullet jackets. Applicant sought to overcome the above difficulties, although a practical solution was not obvious.

A solution to the core-jacket separation problem is achieved by the present invention which provides a method of roughening the inside of bullet jackets by internally vapor blasting bullet jacket in a special support die to reduce relative slip between the resultant bullet jacket and its core. A pressure relief orifice us preferably put in the bullet jacket base and supporting jig to give improved vapor blasting by allowing the vapor blasting media to exit without accumulating in the jacket.

Figure 4:
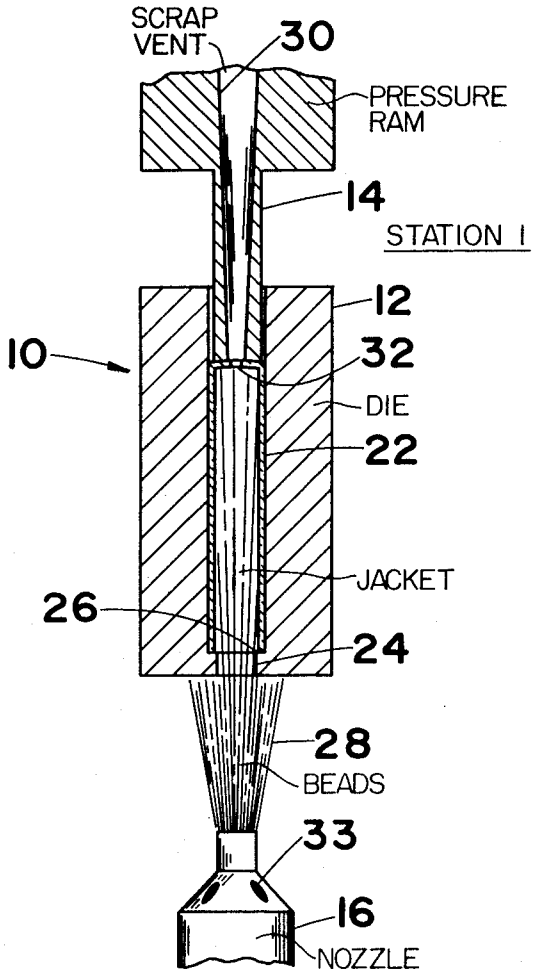

The invention is better understood by reference to the attached detailed description and the drawing which includes:

FIG. 1, a typical PRIOR ART 0.257 Roberts 117 grain soft point bullet jacket;

FIG. 2, a vapor blasted jacket of the invention;

FIG. 3, a vapor blasted jacket of the invention having a pressure relief hole in its base;

FIG. 4, a vapor blasting device of the invention shown during vapor blasting; and FIG. 5, the vapor blasting device of the invention shown during removal of the jacket.

The invention provides a technique for vapor blasting the interior of regular production bullet jackets prior to lead seating. The controlled vapor blasting significantly increases the surface roughness of the bullet jacket interior. As a result, the formed bullet has greater adhesion between the bullet jacket and lead core. Looking to FIGS. 1–3 (which are photographs to better show surface roughness), FIG. 1 shows a conventional prior art bullet jacket design having a relatively smooth interior surface and a single knurl. FIG. 2 shows an internally vapor blasted bullet jacket having a roughened internal surface, a single knurl and FIG. 3 is similar to FIG. 2 but with an optional vent hole in the jacket base to simplify vapor blasting.

The method of accomplishing this on a pilot scale basis was through use of the expendable support device 10 shown in FIGS. 4–5.

Support device 10 includes a die 12, a pressure ram 16, a blasting nozzle 16 and an ejector pin 17. Die 12 has a stepped bore 18 therethrough, bore 18 having a first upper section 20 adapted to surround and laterally support the walls of a bullet jacket preform cup 22. Bore 18 also has a reduced diameter lower section 24 and an inwardly projecting inwardly facing annular shoulder 26 between sections 20 and 24. Shoulder 26 serves to hold the open end of cup 22, which cup is oriented open end down to allow the blasting media 28, preferably glass beads, to fall back out of the cup 22. Nozzle 16 is preferably operated intermittently so as to allow the media to fall down out of the cup 22 and the blasting spurts are of such duration as to continue only until enough of the blasting media accumulates to lower blasting efficiency below some desired level. The timing would be set by trial and error. Also, water blasting such as that in the Maasberg et al U.S. Pat. No. 3,427,763 noted above, is not satisfactory because the water fills up the cup 22 and prevents any significant roughening.

In order to further reduce accumulation of blast media, pressure ram 14 is provided with a scrap vent hole 30 and bullet jacket cup 22 is provided with a vent hole 32 to allow blast media to exit upwardly out through ram 14. Die 12 can be an expendable part as shown or could have some expendable protective layer or shield (not shown) so as to allow use of a conventional vapor blasting nozzle and equipment or by locating the nozzle a short distance below die 12 and simply vapor blasting the bottom of die 12 along with the interior of cup 22. Note that die 12 protects (masks) the exterior of the jacket which should be smooth (not rough) for best aerodynamic performance. Roughening the exterior of the bullet jacket would not increase core jacket adhesion but would cause undesirable air drag during flight.

Ejector pin 17 is sized to pass through section 24 and push cup 22 up out of die 12 for removal.

The preferred media is glass beads of a diameter within the range of from about 0.001 to about 0.010.

One satisfactory nozzle is a 5/16" ceramic nozzle #348-38 distributed by House of Tools, St. Louis, Mo.

The nozzle could have vents 33 to allow the nozzle to be smaller than normal without buildup of media in the nozzle (which buildup would hinder efficient blasting).

As a means of documenting the relative amount of slip between the bullet jacket and lead core of the upset bullets, upset bullets were sectioned and measured from the interior of jacket base to the bottom of the lead core. The three samples that were evaluated are identified in Tables 1 and 2 below.

EXAMPLE 1

Samples of three different bullet jackets (identified as "A", "B", and "C") were tested for bullet integrity at 50 and 200 yard simulated range. The particulars are shown in the table below, which confirms the superior core jacket adhesion in the vapor blasted samples.

Test Conditions:

1. Laboratory bullet samples for the subject investigation were produced as follows:

Vapor blaster equipment:

5/16" ceramic nozzle—348-38

$\frac{1}{8}$" orifice—701-38 vapor blasting media—glass beads, BT8

A. The bullet jackets were placed in a masking fixture which masks (i.e. protectively covers) the outside of the jacket but which left the inside of the jacket exposed so that it could be easily vapor blasted.

B. Samples with no pressure relief orifice were blasted several times with periods between each blast which allows the confined beads to exit the jacket interior by means of gravity. Samples with pressure relief orifices were given on continuous blast (fixture allowed beads to exit).

C. The bullet jackets were cleaned, then assembled by standard operating procedures.

2. Samples were down loaded to give impact velocities which simulate the expected impact velocities under normal conditions at the minimum useful range (50 yards) and the maximum useful range (200 yard) for this cartridge.

TABLE 1

BULLET INTEGRITY - WATER UPSET (50 YARD SIMULATED RANGE)
Test Barrel Z-8, History 2922
n = 20

| | 50 Yard Simulated Range | | | | | |
|---|---|---|---|---|---|---|
| | Impact Velocity (fps) | | Average Diameter Increase | Average Weight Loss | Recorded | Average Relative Slip |
| Sample | Ave. | EV | % | % | CJS | (in.) |
| A Single Knurl (Control) | 2604 | 101 | 130% | 31.8% | **2/20 | .204 |
| B Single Knurl Vapor Blasted | 2630 | 44 | 118% | 30.9% | **2/20 | .160 |

TABLE 1-continued

BULLET INTEGRITY - WATER UPSET (50 YARD SIMULATED RANGE)
Test Barrel Z-8, History 2922
n = 20

| | 50 Yard Simulated Range | | | | | |
|---|---|---|---|---|---|---|
| | Impact Velocity (fps) | | Average Diameter Increase | Average Weight Loss | Recorded | Average Relative Slip |
| Sample | Ave. | EV | % | % | CJS | (in.) |
| C Single Knurl Vapor Blasted* | 2614 | 32 | 111% | 30.6% | 0/20 | .158 |

*A relief pressure orifice was present in base of bullet jacket.
**2 CJS recorded during firing, however, 4 CJS's were found upon inspection of samples

TABLE 2

BULLET INTEGRITY - WATER UPSET (200 YARD SIMULATED RANGE)
Test Barrel Z-8, History 2922
n = 20

| | 200 Yard Simulated Range | | | | | |
|---|---|---|---|---|---|---|
| | Impact Velocity (fps) | | Average Diameter Increase | Average Weight Loss | Recorded | Average Relative Slip |
| Sample | Ave. | EV | % | % | CJS | (in.) |
| A Single Knurl (Control) | 2070 | 39 | 100% | 17.7% | 0/20 | .090 |
| B Single Knurl Vapor Blasted | 2055 | 41 | 87% | 17.2% | 0/20 | **.016 |
| C Single Knurl Vapor Blasted* | 2049 | 42 | 88% | 16.8% | 0/20 | **.011 |

*A relief pressure orifice was present in base of bullet jacket.
**Sectioned bullets which appeared to have no relative slip were assumed to have .010 slip per bullet for purposes of calculating cumulative averages. This assumption was made to insure that lead smear from the saw kerf, when sectioning bullets, did not bias results on low slip bullets. Percentages of bullets which appeared to have no slip for samples B and C were 50% and 80%, respectively.

Test Conclusions:

1. The average relative slip between the bullet jacket and lead core with 50 yard simulated range upset bullets was 0.044" (sample B) and 0.046" (sample C) less than the control sample (sample A). The average relative slip between the bullet jacket and lead core with 200 yard simulated range upset bullets was 0.074" (sample B) and 0.079" (sample C) less than the control sample (sample A).

2.The vapor blasting technique significantly decreases the relative slip between the bullet jacket and lead core at both maximum and minimum ranges which in turn reduces the occurrence of core-jacket separations.

What is claimed is:

1. A method of manufacturing jacketed expanding bullets which comprises the steps of:

a. inserting a cuplike bullet jacket preform cup into a die cavity, the jacket having a base with a central passageway therethrough;

b. holding the jacket cup in the die cavity, and masking and supporting the exterior of the jacket cup while vapor blasting the interior of the jacket cup with blast media, the blast media entering through one end of the jacket and exiting the other end;

c. forcibly seating a lead bullet core into the vapor blasted jacket;

d. forming the blasted jacket cup with seated core into a final bullet configuration.

2. The method of claim 1, wherein said holding step includes holding with a device which has a vent so as to allow vapor and blast media to pass out of the device.

* * * * *